United States Patent [19]

Anderson et al.

[11] Patent Number: 4,703,923

[45] Date of Patent: Nov. 3, 1987

[54] RECIRCULATING AUTOMATIC DOCUMENT FEEDER

[75] Inventors: Carl P. Anderson, San Mateo County; Edward F. Mayer, Santa Clara County, both of Calif.

[73] Assignees: Ricoh Co. Ltd., Tokyo, Japan; Ricoh Systems, Inc., San Jose, Calif.

[21] Appl. No.: 803,649

[22] Filed: Dec. 2, 1985

[51] Int. Cl.[4] ..... B65H 29/70; B65H 31/02

[52] U.S. Cl. ..... 271/3.1; 271/161; 355/14 SH

[58] Field of Search ..... 271/3.1, 4, 301, 161, 271/188, 209, 212; 355/3 SH, 14 SH; 414/37

[56] References Cited

U.S. PATENT DOCUMENTS

| | | | |
|---|---|---|---|
| 2,227,643 | 1/1941 | Hageman | 271/161 X |
| 3,612,512 | 10/1971 | Lang | 271/35 |
| 3,761,080 | 9/1973 | Larson | 271/209 |
| 3,865,253 | 2/1975 | Healy | 214/1 BT |
| 4,289,040 | 9/1981 | Haluko, Jr. | 74/50 |
| 4,336,929 | 6/1982 | Hanzlik | 271/20 |
| 4,353,542 | 10/1982 | Knight et al. | 271/209 |
| 4,413,901 | 11/1983 | Kollar | 271/3.1 |
| 4,433,836 | 2/1984 | Kulpa et al. | 271/3.1 |
| 4,451,028 | 5/1984 | Holmes et al. | 271/34 |
| 4,469,319 | 9/1984 | Robb et al. | 271/3.1 |
| 4,544,148 | 10/1985 | Kitajima et al. | 271/3.1 |
| 4,579,325 | 4/1986 | Pinckney et al. | 271/3.1 |

FOREIGN PATENT DOCUMENTS

| | | | |
|---|---|---|---|
| 553181 | 5/1977 | U.S.S.R. | 271/166 |

*Primary Examiner*—Joseph J. Rolla

*Assistant Examiner*—Frederick R. Handren

*Attorney, Agent, or Firm*—Flehr, Hohbach, Test, Albritton & Herbert

[57] ABSTRACT

A document feeder is disclosed wherein a document stack is bent or curved when it rests on a fixed curved stackholding tray. A stack of paper becomes rigid when curved, and therefore, capable of being raised by applying an upward force along the curved edge on each end of the stack provided by a pair of curved lifting blades which move horizontally relative to the ends of the stack to move in and out underneath the edges of the stack, and thereafter move vertically to lift the entire stack out of the path of the returning copy. The document to be copied may be lifted off the top of the document stack either before or after the lifting action of the blades. A vacuum belt type arrangement is provided for moving successive documents from the top of the stack. The document loops through the machine, and returns at a lower level, aligned with an opening beneath the bottom of the stack. A levered plate is provided at the trailing lateral edge of the stack to be sure that the edges of the stack are lifted out of the return paper document path. Moving the belts running beneath the stack carry the returning document into alignment under the stacks; a metal plate running horizontally or laterally along the edge of the stack perpendicular and very close to the belts acts as a stop to stop the returning document in alignment with the document stack being fed. Once the document is returned, the lifting blades move vertically downward, and laterally outward, resting the remainder of the document stack on the returned document and making it a part of the stack.

16 Claims, 5 Drawing Figures

RECIRCULATING AUTOMATIC DOCUMENT FEEDER

BACKGROUND OF INVENTION

The present invention relates generally to an electrophotographic copying apparatus and more particularly to one designed to make copies of a stack of original documents automatically. This particular apparatus uses a feeding arrangement configured to act on the stack in a way which successively moves each document of the stack from the top of the stack through the copying apparatus and thereafter back to the bottom of the stack.

It is quite desirable to be able to feed an entire stack of documents one at a time through a copying machine without hand-feeding, and to have each document returned to the bottom of the stack. In this way, when the stack has been completely copied, it is in its original order when the stack of documents is removed from the machine. Further, separate trays do not need to be provided to receive the original documents to be copies and those which have been copied, minimizing the overall size of the machine.

It is therefore an objective of the present invention to provide an improved recirculating automatic document feeder.

More particularly, it is an objective herein to provide an automatic document feeder which feeds each document in turn from the top of the stack, along a looped path through the copying machine and turns the document in its original orientation to the bottom of the stack.

A major problem in the design of such a system is that in order to return each copied document to the bottom of the stack, the stack must somehow be lifted once during each copy cycle, after the copy is made, so that the returning document may slide into its place underneath the stack of documents, properly aligned with the complete stack.

It is therefore an objective of the present invention to provide a recirculating document feeder which lifts the stack of documents to be copied by the edge of the documents in a timely, sequential fashion so that each returning document slides into its place at the bottom of the document stack, and the stack is then returned to rest on the returned document; in this way, upon completion of the next copy cycle, the complete stack may again be lifted out of the returning document path.

SUMMARY OF INVENTION

As discussed above and as will be seen in more detail hereafter, the recirculating automatic document feeder of the present invention is especially designed for use in an electrophotographic apparatus which includes the present arrangement configured to act on the stack in a way which successively moves each document onto a copying platen from the top of the stack when the stack is placed in a feed tray,; the electrophotographic apparatus including means for scanning the master document now on the platen to create an image thereof on a photoconductor element, developing the image, moving the photoconductor element and a transfer document through a transfer station to effect a transfer of toner particles from the photoconductor element to the transfer document, and thereafter returning the copied master document to the bottom of the stack properly aligned with the stack along a looped path of movement from the tray to platen and back to tray. Specific details of the components of the electrophotographic apparatus, including the copying platen, may be found in U.S. Pat. No. 4,384,784 assigned to the Assignee of the present invention.

The present invention essentially comprises a document stack which is bent or curved when it rests on a fixed curved stack-holding tray. The reason for providing this curved stacking tray is that a stack of paper becomes rigid when curved, and therefore, capable of being raised by applying an upward force along the curved edge on each end of the stack. In order to provide this edge-lifting force, a pair of curved lifting blades having the curvature of the stack are provided which move horizontally relative to the ends of the stack to move in and out underneath the edges of the stack, and thereafter move vertically to lift the entire stack out of the path of the returning copy. The document to be copied may be lifted off the top of the document stack either before or after the lifting action of the blades.

Preferably, a vacuum belt type arrangement is provided for moving successive documents from the top of the stack into the electrophotographic copying machine. The document loops through the machine, and returns at a lower level, aligned with an opening beneath the bottom of the stack. A levered plate is provided at the trailing lateral edge of the stack to be sure that the edges of the stack are lifted out of the return paper document path. Moving belts running beneath the stack carry the returning document into alignment underneath the stacks, a metal plate running horizontally or laterally along the leading edge of the stack perpendicular and very close to the belts acts as a stop to stop the returning document in alignment with the document stack being fed.

Once the document is returned, the lifting blades move vertically downward, and laterally outward, resting the remainder of the document stack on the returned document and making it a part of the stack; when the lifting blades again perform their cyclic motion, they again move underneath the bottom edges of the stack, and lift the stack, including the returned document.

The overall circulating automatic document feeder of the present invention disclosed herein will be described in more detail hereinafter in conjunction with the drawings wherein

DETAILED DESCRIPTION OF PREFERRED EMBODIMENT

Figure 1:
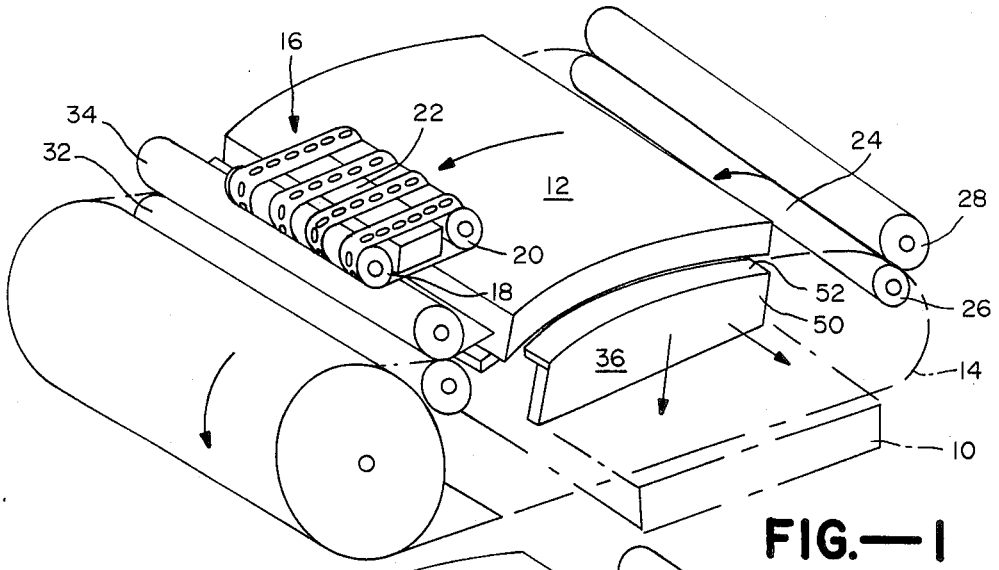
FIG. 1 and FIG. 2 are perspective views of the recirculating document feeder of the present invention showing many of its essential elements, and the circulation path of the documents.
Figure 2:
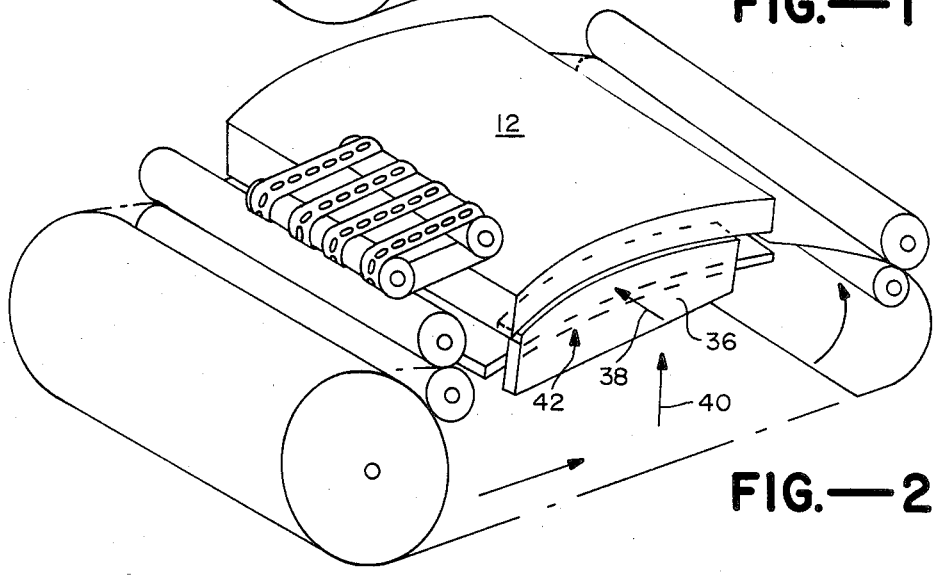

Turning now to the drawings, wherein like components are designated by like reference numerals throughout the various figures, attention is first directed to FIGS. 1 and 2 which illustrate the overall structure of the recirculating automatic document feeder of the present invention which is used in conjunction with an electrophotographic copying apparatus generally indicated by reference numeral 10.

The document feeding arrangement of the present invention is designed to automatically feed one document at a time lifted from the top of a stack of documents 12 along a path 14 in the direction of the arrows. The top document pick-off is achieved using a plurality of vacuum type belts generally indicated at 16 rotating about a pair of rollers 18, 20 and utilizing a vacuum source 22 to pick off the top sheet of the stack of documents 24 and feed it through feed rollers 32, 34 toward the copying apparatus 10. The copied document circulates along the path 14, returning through an exit roller and transfer rollers 32, 34, which are a part of the copying machine, to be placed at the bottom of the stack.

Figure 3:
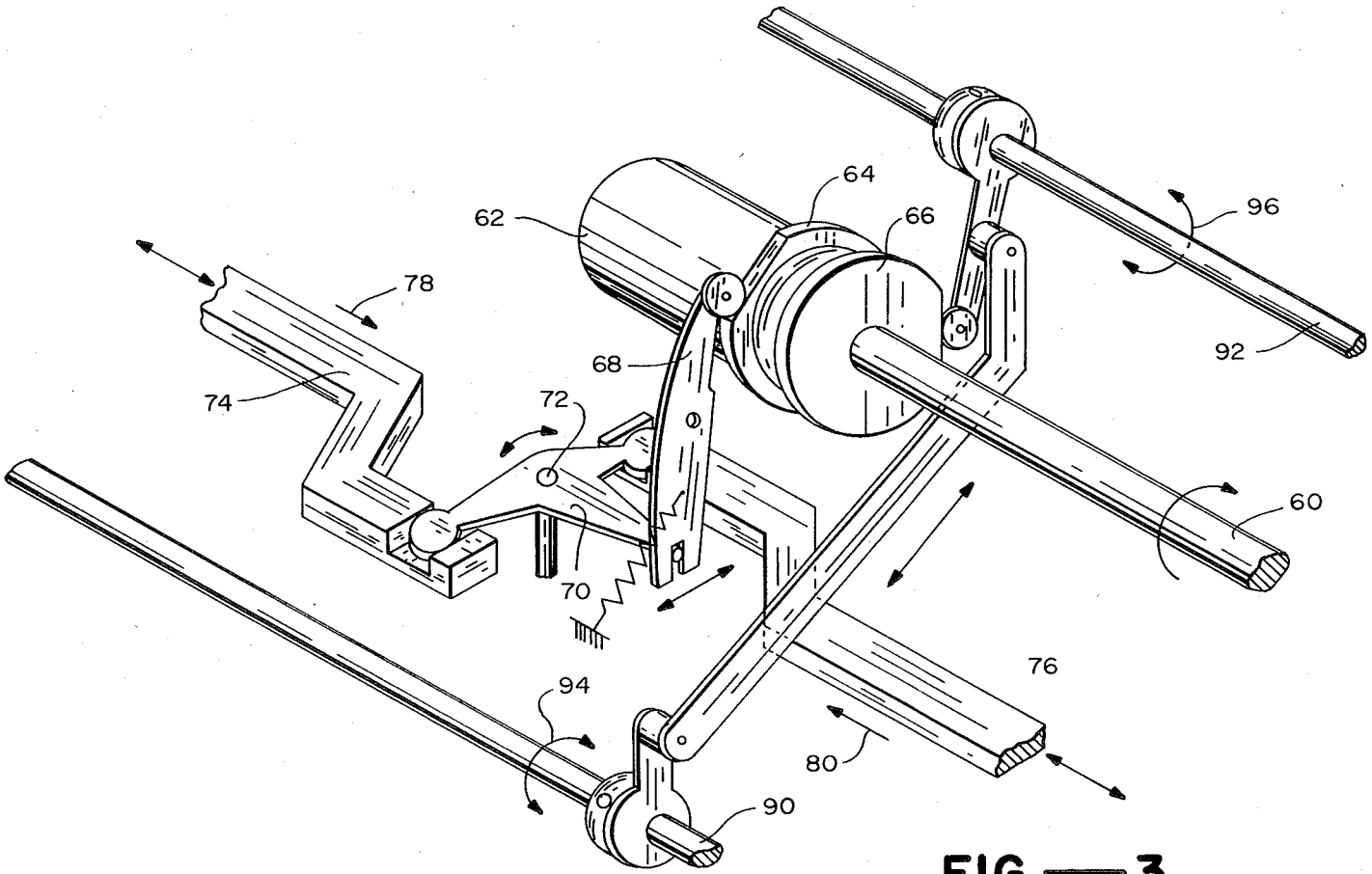
FIG. 3 shows the camming arrangement which controls the timing of the lateral and vertical motion of the lifting blades, as well as the plate which clears a path for the return of the document.

As shown in FIG. 1, the top document may be picked off when the lifting blades 36 are lowered and moved outward from the bottom of the document stack so that the stack is not elevated. However, the document can be as easily removed when the stack is in its lifted position, the lifting blade 36 (and its hidden coordinated lifting blade on the other end of the stack, not shown) has moved first inward along arrow 38 and then upward in the direction of arrow 40 utilizing a mechanism to be shown in detail in FIGS. 3–5.

Whichever position the document stack is in when the top document is being removed must be taken into account due to the fact that greater pressure will exist between the vacuum feed rollers 16 and the top sheet 24 which is to be removed. In any event, horizontal movement 38 of the curved lifting blades and vertical movement 40 of the blades lifting the curved stack from the curved tray 42 is necessary to clear the return path of the document.

It can be seen, especially in FIG. 1, that the lifting of the documents is accomplished using a pair of lifting blades, one on either side of the document stack 12. One of which blades 36 is shown clearly in FIG. 1. The blades are curved in the direction of movement of the document. The blades are positioned to lift the document stack along its shorter edges, or width. It is important to note that the top surface or shoulder 52A, 52B of the blades 36 is curved to provide a curvature in the paper stack. This curvature, having a radius in the direction of the paper to be withdrawn, allows the entire stack of paper 12 to be lifted only by its edges. Thus the edges of the curved stack 12 rest on the curved shoulders 52 of lifting plates 42 as the plates raise the stack. This movement clears the paper return path.

Figure 5:
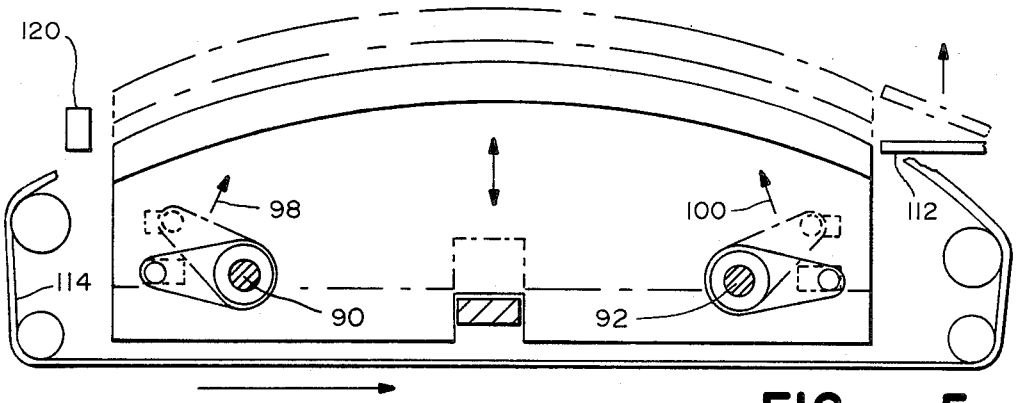
FIG. 5 is a vertical elevation view of the lifting rods which lift the blades and thereby the edges of the stack as well as lifting a plate which clears a path for the return of the documents.
Figure 4:
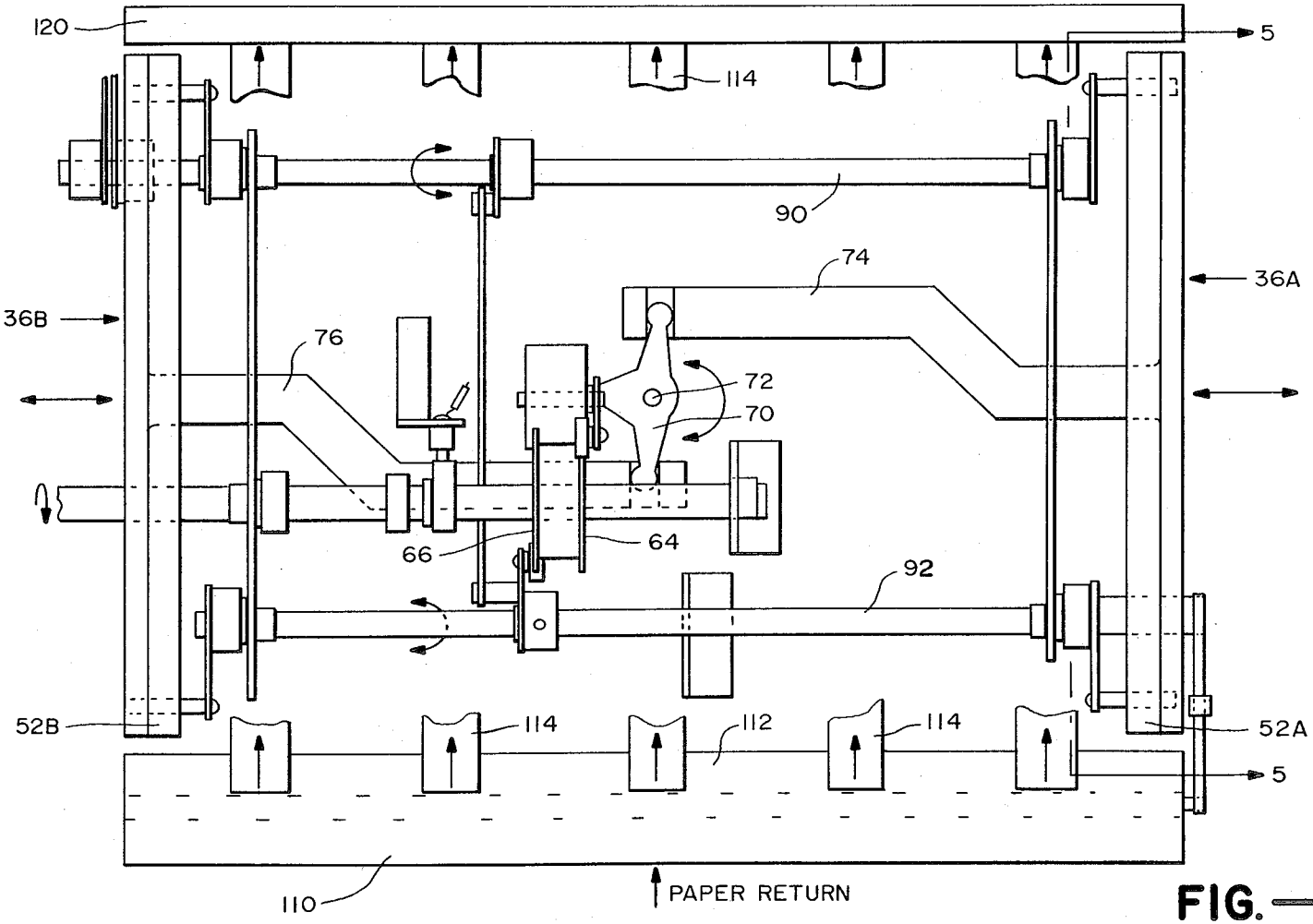
FIG. 4 is a horizontal plane view of essential mechanical elements of the present invention including many of the elements of FIG. 3 which carry out the lateral and vertical movement of the lifting blades of the present invention.

In a preferred embodiment, each lifting blade comprises a side panel 50 and a shoulder panel 52 (see FIG. 4 where the two blades are labelled 52A, 52B as they are of symmetrical construction). As shown in FIGS. 1 and 2, the lifting blades are moved first in along arrow 38, and then up in the direction of arrow 40. This sequence of motion is accomplished by timing means which essentially comprise a rotating shaft 60 which is engaged using clutch 62 to rotate a pair of cams 64, 66. Rotation of the cam 64 through a lever 68 causes movement of the double-armed transfer device 70 about pivot 72 to pull both levers 74, 76 inward along the arrows 78, 80. These levers are attached (as shown in FIG. 4) to the lifting blades 36A, 36B, the blades move in underneath the stack of paper so that the shoulders 52A, 52B now rest under the edges of the stack. The lifting of the stack is now accomplished by the rotation of cam 66 which causes rotation of both of rods 90, 92, the rods rotating in opposite directions as shown by arrows 94, 96. Rotation of these causes a lifting motion of the ends of the lifting blades because of the coupling between the ends of these rods and the ends of the lifting blades which is illustrated in FIG. 5. The counter rotation of these two rods causes both of them to move up in the direction of arrows 98, 100, lifting the lifting blades and lifting the paper along with it.

It should be noted as shown in FIG. 4 that a metal plate 110 is provided at the side of the device where the paper returns; the plate's leading edge 112 is notched to ordinarily let the belts 114 which carry the paper past the returning paper document pass through. The edge 112 of this plate is lifted (see FIG. 5 which schematically illustrates lifting of the trailing edge of the stack of paper) so that the returning paper document may easily pass underneath this plate 110 and the paper stack 12 on the belts. The plate 110 serves to lift edges of the stack 12 of documents being copied so they do not interfere with the return of the paper. A second plate 120 is provided which is located barely over the top surface of the belts 114 at the leading of the document space to serve as a paper stop, so that the returning paper butts up against the plate 120 and ends up in alignment under the document stack. The document stack remains stationary when it has been lowered onto the belts by virtue of the fact that the belts stop moving when the document stack is lowered. This can be provided by an interlock which activates the belt when the stack lifters are activated to raise the document stack. When a document is being returned, the leading edge of the plate 112 is lifted so that the returning paper document can pass under the edge of the plate and the trailing edge of the documents forming the paper stack while the document stack is lifted. Thus, the paper rides on the belts under the plate 110, 112 underneath the document stack and butts up against the stopper plate 120 to stop in place beneath the stack.

Alternatives to the implementation of the present invention may become apparent to a person of skill in the art who studies the above disclosure. Therefore, the scope of the present invention is to be limited only by the following claims.

What is claimed:

1. Electrophotographic apparatus for producing successive copy documents from a stack of master documents having a defined minimum width, the apparatus including a feeding arrangement configured to act on the stack in a way which successively moves each document from the top of the stack onto a copy platen aligned with a scanning means and thereafter returning said master document to the bottom of the stack comprising, bending means for supporting the stack and for imparting a curvature to the stack;

means for removing the top document from the stack of documents;

means for lifting the stack of documents comprising a pair of horizontally and vertically movable curved blades having a radius of curvature about a horizontal axis located below the stack and oriented transversely to removing and returning movement of the documents, the blades contacting the bottom edges of the stack when lifting the stack, the lifted stack being held in a curved shape by said blades;

means for returning the removed document to the bottom of the stack in the same orientation in which it was moved;

timing means for relating the movement of said lifting means and the document return means, said timing means comprising means for periodically moving said lifting blades within said minimum width of said stack to lift said stack and allow said document return, and outside said minimum stack width to rest the stack on the returned document, and a plate means running parallel to the axis of the curved surface defined by the curved blades and aligned with an edge of the document stack to support the edge of the document stack, when lifted, out of the returning document path.

2. Apparatus as in claim 1 wherein said document removing means are in contact with the top of the stack when the stack is lifted to remove the top document from the stack.

3. Apparatus as claimed in claim 2 wherein said document removing means comprise a belt rotating about an axis parallel to the axis of the curved surface defined by the paper to remove the top document of the stack.

4. Apparatus as claimed in claim 3 wherein said rotating belt comprises a vacuum cooperating with openings in the belt to remove the top document of the stack.

5. Apparatus as in claim 1 wherein said timing means comprise a rotating shaft carrying cam means for controlling the position of the lifting blades relative to the paper stack, said cam means being connected to said rotating shaft and a shifting means for said lifting blades to move said blades to a position inside the minimum width of the document stack, said cam means being further connected to said rotating shaft and a blade lifting means for lifting the blades and the document stack to allow document return to the bottom of the stack.

6. Apparatus as in claim 5 wherein said blade lifting means comprise a pair of lifting rods running parallel to the axis of curvature of the paper, and connected by said cam means to said rotating shaft, said blades resting on the lifting rods whereby rotation of said cam causes periodic lifting of said blades and document stack.

7. Apparatus as claimed in claim 6 wherein said timing means drive shaft is constantly rotating, said apparatus including clutch means for periodically engaging said shaft to cause movement of said lifting blades incident to removal and return of a document for copying.

8. Apparatus as claimed in claim 7 wherein said document return means includes a second plate running parallel to an axis of the curved surface defined by the lifting blades and over a plurality of paper return belts for returning documents to the document stack at the leading edge of the stack for stopping returning documents under the stack.

9. Apparatus as in claim 1 wherein said bending means comprise a curved document tray on which the documents rest for imparting the curvature to the stack.

10. Electrophotographic apparatus for producing successive copy documents from a stack of master documents, the apparatus including support means for supporting a stack of documents and a feeding arrangement configured to act on the stack in a way which successively moves each document from the top of the stack onto a copy platen aligned with a scanning means and thereafter returning said master document along a path to the bottom of the stack, the stack having a defined minimum width, comprising means for removing the top document from the stack of documents, means for periodically raising and lowering the stack of documents comprising a pair of horizontally and vertically movable lifting blades having a radius of curvature about a horizontal axis located below the stack and oriented transversely to removing and returning movement of the documents, the blades maintaining the document stack in a curved configuration when lifting the stack, the blades being movable from a first position outside the minimum width of the documents to position the blades to lift the documents, plate means running parallel to an axis of the curved surface defined by the curved blades and aligned with an edge of the document stack to support the edge of the document stack, when lifted, out of the returning document path, timing means for timing the movement of the lifting blades relative to removal and return of the document comprising means for periodically moving said lifting blades within said minimum width of said stack to lift said stack to allow said document return, and outside said minimum stack width to rest the stack on the returned document, and paper return means for returning the removed document to the bottom of the stack in the same orientation in which it was removed.

11. Apparatus as claimed in claim 10 wherein said support means comprises bending means including a curved document tray on which the document stack rests to impart a curvature to the stack whereby the lifting blades lift the bent stack.

12. Apparatus as claimed in claim 11 wherein said paper return means includes a second plate running parallel to the axis of the curved surface defined by the lifting blades and over a plurality of paper return belts for returning documents to the document stack at the leading edge of the stack of stopping returning documents under the stack.

13. Apparatus as claimed in claim 10 wherein said timing means comprise a rotating shaft carrying cam means for controlling the position of the lifting blades relative to the stack, said cam being connected to a first drive rod means connected to said lifting blades to move said blades to a position inside the minimum width of the document stack, said cam means being further connected to means for lifting the blades and the document stack to allow document return to the bottom of the stack.

14. Apparatus as claimed in claim 13 wherein said blade lifting means comprise a pair of lifting rods running parallel to the axis of curvature of the stack, and connected through drive rods to the cam means, said blades resting on the lifting rods whereby rotation of said cam causes periodic lifting of said blades and document stack.

15. Apparatus as claimed in claim 13 wherein said timing means rotating shaft is constantly rotating, said apparatus including clutch means for periodically engaging said shaft to cause movement of said lifting blades incident to removal and return of a document for copying.

16. Apparatus as in claim 10 wherein said paper return means for returning the removed document comprise belts running under said plate means to carry the paper past the plate means and under the bottom of the document stack.

* * * * *